US007552585B2

(12) United States Patent
Rigaudeau et al.

(10) Patent No.: US 7,552,585 B2
(45) Date of Patent: Jun. 30, 2009

(54) AID SYSTEM FOR REGENERATION OF A PARTICLE FILTER IN AN EXHAUST LINE OF A DIESEL ENGINE

(75) Inventors: Christine Rigaudeau, Puteaux (FR); Yvan Agliani, Paris (FR); Marion Wermester, Le Pecq (FR)

(73) Assignee: Peugeot Citroen Automobile SA, Velizy Villacoublay (FR)

( * ) Notice: Subject to any disclaimer, the term of this patent is extended or adjusted under 35 U.S.C. 154(b) by 615 days.

(21) Appl. No.: 10/541,549

(22) PCT Filed: Jan. 6, 2004

(86) PCT No.: PCT/FR2004/000007

§ 371 (c)(1),
(2), (4) Date: Jul. 6, 2005

(87) PCT Pub. No.: WO2004/070177

PCT Pub. Date: Aug. 19, 2004

(65) Prior Publication Data

US 2006/0144039 A1 Jul. 6, 2006

(30) Foreign Application Priority Data

Jan. 7, 2003 (FR) ..... 03 00109
Jan. 7, 2003 (FR) ..... 03 00112

(51) Int. Cl.
*F01N 3/00* (2006.01)

(52) U.S. Cl. ..... 60/295; 60/278; 60/280; 60/286; 60/297; 60/311

(58) Field of Classification Search ..... 60/278, 60/280, 286, 295, 297, 311
See application file for complete search history.

(56) References Cited

U.S. PATENT DOCUMENTS 4,835,964 A * 6/1989 Kume et al. ..... 60/285

(Continued)

FOREIGN PATENT DOCUMENTS

DE 199 21 974 A1 11/2000

(Continued)

OTHER PUBLICATIONS

Patent Abstracts of Japan, Publication No. 56148607, published on Nov. 18, 1981.

(Continued)

*Primary Examiner*—Thomas E Denion
*Assistant Examiner*—Diem Tran
(74) *Attorney, Agent, or Firm*—Nicolas E. Seckel

(57) ABSTRACT

A system for assisting regeneration of a particle filter in an exhaust line (3) of a motor vehicle diesel engine (1) associated with:

air admission means (2);
exhaust gas recycling means (4);
a turbocompressor (5);
a particle filter (7);
a common system (8) for feeding fuel to the engine;
means (16) for adding to the fuel an additive adapted to be deposited on the particle filter (7) to reduce the combustion temperature of particles trapped therein;
means (20, 21, 22) for acquiring information relating to operation of the engine; and
monitoring means (17) adapted to trigger a phase of regeneration of the particle filter by combustion of the particles trapped therein by triggering a phase of multiple injection of fuel.

The filter (7) is impregnated with a catalyst for oxidizing hydrocarbons and CO present in the exhaust gases.

6 Claims, 2 Drawing Sheets

U.S. PATENT DOCUMENTS

| | | | | |
|---|---|---|---|---|
| 5,089,237 | A | 2/1992 | Schuster et al. | |
| 5,758,496 | A | 6/1998 | Rao et al. | |
| 5,813,223 | A * | 9/1998 | Barthe et al. | 60/274 |
| 6,378,297 | B1 * | 4/2002 | Ito et al. | 60/284 |
| 6,952,918 | B2 * | 10/2005 | Imai et al. | 60/295 |
| 2004/0065078 | A1 * | 4/2004 | Schafer-Sindlinger et al. | 60/295 |

FOREIGN PATENT DOCUMENTS

| | | | |
|---|---|---|---|
| DE | 100 48 511 | A1 | 4/2002 |
| WO | WO 01/12320 | A1 | 2/2001 |

OTHER PUBLICATIONS

Patent Abstracts of Japan, Publication No. 10244167, published on Sep. 14,1998.

Patent Abstracts of Japan, Publication No. 03033419, published on Feb. 13, 1991.

* cited by examiner

AID SYSTEM FOR REGENERATION OF A PARTICLE FILTER IN AN EXHAUST LINE OF A DIESEL ENGINE

BACKGROUND ART

The invention relates to the automotive industry and more particularly to reducing the pollution caused by internal combustion engines, in particular diesel engines.

The exhaust lines of diesel engine motor vehicles of recent design are equipped with various devices for treating pollutants produced by combustion of fuel in the engine.

A first of those devices oxidizes the exhaust gases by passing them over an oxidation catalyst.

A second of those devices, generally disposed immediately downstream of the previous device, is a particle filter on which particles (known as soot) produced by combustion are deposited. This soot must be burned off periodically, in particular by increasing the temperature of the particle filter or the exhaust gases, to prevent the filter from becoming clogged and to restore its original performance (which operation is known as regeneration).

To assist this combustion of the soot, a suitable device may be used to add to the fuel an additive such as ceria and/or iron oxide that mixes with the soot and reduces its combustion temperature. The particle filter must be cleaned to remove the additive and various unburned residues approximately every 80,000 kilometers (km) or 120,000 km, for example.

Executing these oxidation and filtration functions in separate devices leads to very bulky exhaust line designs or to having to carry out thorough cleaning of the particle filter at intervals that might be deemed too frequent.

BRIEF SUMMARY OF THE INVENTION

The object of the invention is to enable the manufacturer to reduce the overall size of motor vehicle diesel engine exhaust lines and/or to reduce the frequency of thorough cleaning of the particle filter necessary for good operation of the exhaust line.

To this end, the invention consists in a system for assisting regeneration of a particle filter integrated in an exhaust line of a motor vehicle diesel engine, the engine being associated with various units, including:

- means for admitting air into the engine;
- means for recycling exhaust gases from the engine to the inlet thereof;
- a turbocompressor;
- a particle filter;
- a common system for feeding fuel to the cylinders of the engine, including electrical fuel injectors associated with those cylinders;
- means for adding to the fuel an additive adapted to be deposited on the particle filter to reduce the combustion temperature of particles trapped therein;
- means for acquiring information relating to various operating parameters of the engine and the units associated therewith; and
- means for monitoring the operation of the air admission means, the turbocompressor and/or the fuel feeding system in order to monitor the operation of the engine, these monitoring means being further adapted to trigger a phase of regenerating the particle filter by combustion of the particles trapped therein by triggering a phase of multiple injection of fuel into the cylinders of the engine during their expansion phase;

the system being characterized in that the particle filter is impregnated with a catalyst for oxidizing hydrocarbons and CO present in the exhaust gases flowing through said particle filter.

Said catalyst may be a metal or a mixture of metals.

Said metal may be a group VIII metal, such as platinum, palladium, or rhodium, or a mixture of such metals.

The particle filter may have a region that is more strongly impregnated with the oxidation catalyst.

Said more strongly impregnated region may be situated at the centre of the cross-section of the particle filter.

Said more strongly impregnated region may be situated at the inlet of the particle filter.

The area of said more strongly impregnated region may represent from 20% to 70% of the cross-section of said particle filter.

Said more strongly impregnated region may occupy from 10% to 50% of the length of the particle filter starting from its inlet face.

The terminal portion of the particle filter may not be impregnated with the oxidation catalyst.

Clearly, one essential feature of the invention is performing the operations of oxidizing the exhaust gases and filtering the particles within the same reactor. This is achieved by impregnating the material of the particle filter with an oxidation catalyst such as a metal, for example platinum.

BRIEF DESCRIPTION OF THE DRAWINGS

The invention will be better understood on reading the following description with reference to the appended drawings, in which.

DETAILED DESCRIPTION OF PARTICULAR EMBODIMENTS

Figure 1:
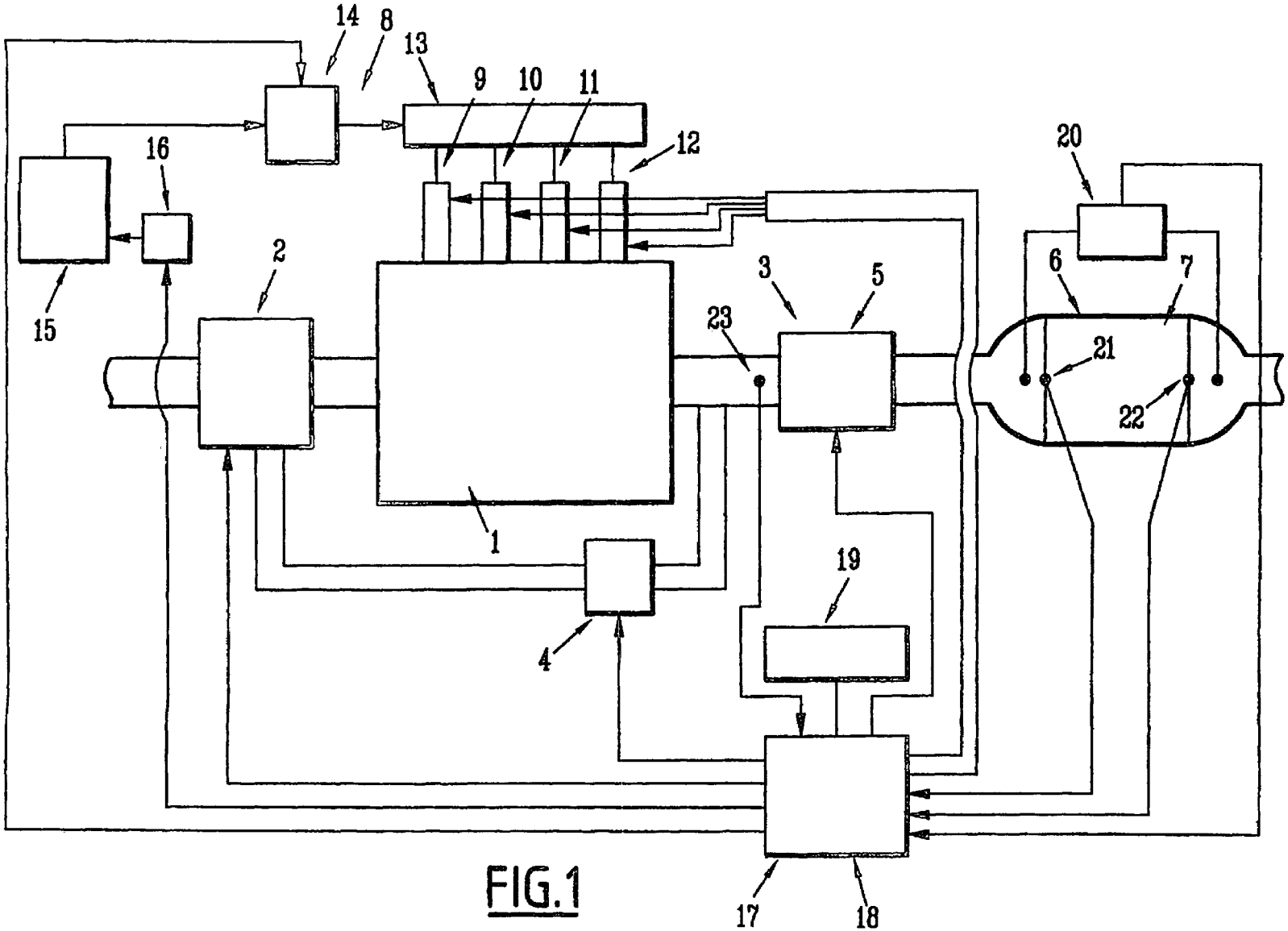
FIG. 1 is a diagram of a vehicle diesel engine and various units associated therewith.

FIG. 1 shows a motor vehicle diesel engine 1.

The diesel engine is associated with means 2 for admitting air into the inlet side of the engine.

On its outlet side, the engine is associated with an exhaust line 3.

Means 4 for recycling the exhaust gas from the engine to the inlet side thereof are also provided.

Those means are disposed between the outlet side of the engine and the means 2 for admitting air into the engine, for example.

The exhaust line may also be associated with a turbocompressor 5, and more particularly with the turbine portion thereof, in the conventional way.

Finally, according to the invention, the exhaust line includes a casing 6 containing a particle filter 7 impregnated with an oxidation catalyst. The "oxidation" and "filtration" functions are therefore executed in the same medium, in contradistinction to the prior art, where the gases pass successively through an oxidation medium and a filtration medium each dedicated to one of these functions and not to the other one.

The engine is also associated with a system 8 common to all the cylinders of the engine for feeding fuel to the cylinders. This system includes electrical injectors associated with the cylinders.

In the embodiment shown, the engine is a four-injectors 9, 10, 11 and 12.

The various injectors are associated with a common fuel supply manifold 13 connected to fuel feed means 14 comprising a high-pressure pump, for example.

The fuel feed means are connected to a fuel tank 15 and to means for adding to the fuel an additive intended to be deposited on the particle filter to reduce the combustion temperature of the particles trapped therein.

The additive may be contained in an auxiliary tank 16, for example, associated with the fuel tank 15, to enable a certain quantity of the additive to be injected into the fuel.

Finally, the engine and the various units described above are also associated with means 17 for monitoring their operation, comprising, for example, an appropriate computer 18 associated with information storage means 19 and connected on its input side to various means for acquiring information relating to various operating parameters of the engine and these units, the computer being adapted to monitor the operation of the air admission means, the recycling means, the turbocompressor, and/or the fuel feed means in order to monitor the operation of the engine and in particular the torque generated thereby as a function of the conditions of operation of the vehicle, in the conventional way.

For example, the computer is connected to a differential pressure sensor 20 connected across the particle filter 7 and to temperature sensors 21 and 22 respectively on the inlet side of the particle filter and on the outlet side of the particle filter in the exhaust line.

The computer may also receive information on the oxygen content of the exhaust gases from a Lambda λ probe 23 integrated into the exhaust line.

The output of the computer controls the air admission means, the exhaust gas recycling means, the turbocompressor, the means for adding the additive to the fuel, the means for feeding fuel to the common manifold, and the various injectors associated with the cylinders of the engine.

In particular, the computer is adapted to trigger a phase of regenerating the particle filter by combustion of particles trapped therein by instigating a phase of multiple injections of fuel into the cylinders of the engine during their expansion phase.

The particles that are emitted by the engine while in operation are trapped in the particle filter. It is then necessary to regenerate the filter regularly by burning off these particles.

In conventional systems in which the oxidation and filtration functions are separate, during normal operation phases, the engine emits exhaust gases at a temperature of 180° C. to 200° C. essentially containing hydrocarbons, CO, $CO_2$, water vapor, $NO_x$, oxygen, and particles. The reactor containing the oxidation catalyst (generally a metal such as platinum) uses oxygen to convert around 90% or more of the CO and of the hydrocarbons into $CO_2$ and water vapor. The combustible fraction of the soot (also known as the "soluble organic fraction" (SOF)), in the form of hydrocarbons condensed on the particles, is also treated by the oxidation catalyst. At the exit of the oxidation catalytic converter, the exhaust gases therefore contain significant amounts of residual oxygen, $CO_2$, water vapor (where $CO_2$ and water are present in greater quantities than on the inlet side of the oxidation catalyst), $NO_x$, and particles, only. These rejected substances then enter the particle filter, where the particles are deposited on the walls of the filter. What is exhausted to the atmosphere then contains significant amounts of oxygen, $CO_2$, water vapor, and $NO_x$, only. However, the $NO_x$ can be treated in a $NO_x$ processing device such as a $NO_x$ trap and therefore not exhausted to the atmosphere.

In the system of the invention the reactor as such containing oxidation catalyst is eliminated. Its function is transferred to the particle filter 7, which is constituted of a material conventionally used for this purpose (such as a ceramic material, for example silicon carbide), but which is impregnated with an oxidation catalyst such as platinum and/or palladium. The catalyst is carried by a "washcoat" of oxide (for example $Al_2O_3$) that may also contain substances having an oxygen storage capacity (OSC), for example materials of the group comprising cerium oxide and/or mixed cerium and zirconium oxide. Only the surface of the pores or the whole of the material need be impregnated. The material may be adapted, from the point of view of its porosity and the distribution of the pore diameters, so that the catalyzed oxidation reaction occurs therein with optimum efficiency, comparable to that observed in conventional separate oxidation reactors, without producing an excessive back-pressure that would impede the flow of the gases. In a conventional particle filter the pore size is centered on a size of approximately 9 micrometers (μm). In an impregnated particle filter of the invention, the pore size may be centered on sizes from 11 μm up to 20-30 μm. These values are given merely by way of example.

If an exhaust line including a particle filter 7 modified in accordance with the invention is compared with an exhaust line including a conventional particle filter situated immediately downstream from an oxidation catalytic converter, it is found at the inlet of the particle filter 7 modified in accordance with the invention, that the emissions of gases and particles are identical to those that usually enter the oxidation reactor. At the outlet of the particle filter 7 modified in accordance with the invention, the emissions of gases are identical to those at the outlet of prior art particle filters.

A noteworthy advantage of the invention is that the SOF of the soot is not treated before the soot passes through the particle filter 7 and is therefore available to facilitate combustion of the soot during the regeneration phases, by the heat given off locally by the combustion of the SOF.

As mentioned above, the particle filter 7 is periodically regenerated, during which phase the soot that is clogging it in part is burned off. When to effect this regeneration may be chosen in various ways. Regeneration may be effected systematically when the vehicle has traveled a given distance since the previous regeneration or if the differential pressure sensor 20 registers a high pressure difference between the inlet and outlet gases, a sign that the particle filter 7 is beginning to become clogged. Triggering can also be decided on by estimating the quantities of soot accumulated in the particle filter 7 by consulting a diagram based on the type of vehicle operation effected.

For the purposes of this regeneration, an additive may be added to the fuel to assist regeneration, such as cerine, which reduces the combustion temperature of the soot to around 450° C. and which supplies available oxygen to support combustion. At the time of regeneration, additional fuel may be injected on the inlet side of the particle filter 7, for example by triggering a phase of multiple injections into the cylinders of the engine 1 during their expansion phase. The object of this additional injection is to increase the temperature of the exhaust gases and their concentration of hydrocarbons and CO compared to phases of normal use of the engine 1.

In conventional systems with separate oxidation reactors and particle filters, this additional injection is effected ahead of the oxidation reaction. This partly converts the CO and the additional hydrocarbons, involving the consumption of oxygen, which increases the temperature of the gases to 450° C. or more, and thus enables combustion of the soot in the particle filter. The additive for assisting regeneration assists in the propagation of combustion within the soot.

In the system of the invention, all the reactions referred to above take place within the particle filter 7, directly on the catalyst-impregnated filter medium constituting it. In particular, the exothermic reaction of converting the hydrocarbons and CO emitted in large quantities takes place in the immediate vicinity of the bed of soot, which makes it even more efficient at increasing the temperature of the soot and thus of initiating its combustion.

What is more, since this exothermic reaction is more efficient, the quantity of additive may be reduced. For the same filtration volume, slower soiling by the unburned residues is therefore observed.

Furthermore, in the situation of the invention there is only one reactor 6, instead of two entirely separate or back-to-back reactors. This makes the exhaust line 3 easier to assemble.

Figure 2:
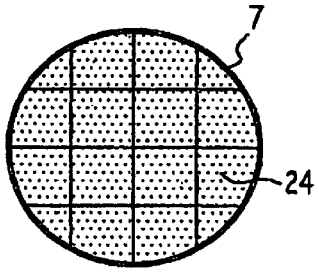
FIG. 2 is a diagram of a homogeneously impregnated example of a particle filter of the invention.

FIG. 2 is a diagram in cross-section of an example of a circular section particle filter 7 divided into a plurality of modules 24 which are homogeneously impregnated with catalyst over their cross-section and their length.

In a preferred variant of the invention, the particle filter 7 is not homogeneously impregnated with the oxidation catalyst. The amount of catalyst is increased in the regions of the particle filter 7 where thermal condition are the most favorable and where there are the greatest gas flows, in order to accentuate the conversion of the CO and the hydrocarbons there and in order to prevent catalytic aging of the filter in regions of greater thermal stress.

The distribution of the catalyst may be non-homogeneous in the radial direction of the particle filter 7 and/or in the axial direction of the particle When the particle filter 7 is installed in the exhaust line, the trajectory of the gaseous flows coming from the combustion chamber causes a flowrate gradient within the particle filter 7. The magnitude of this gradient depends on the engine operating conditions and on the shape of the cone connecting the main exhaust line and the particle filter 7. The phenomenon is reflected in higher gas velocities at the centre of the particle filter 7, whereas the gas flowrates are significantly reduced in the radial direction towards the periphery of the particle filter 7. This phenomenon has the consequence that the temperatures at the centre of the particle filter 7 are higher than those at its periphery. This phenomenon is accentuated by certain particle filters of high conductivity (for example those based on SiC), compared to a conventional catalyst. The temperature tends to fall strongly toward the periphery and over the length of the particle filter 7.

To take account of this phenomenon, it is proposed to adopt distributions of the impregnation of the particle filter 7 such as those shown in the diagrams of FIGS. 3 to 6.

Figure 3:
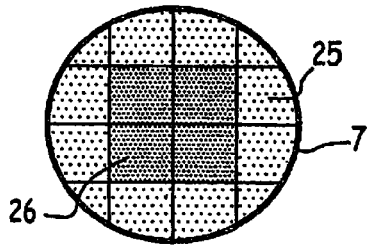
FIGS. 3 to 6 are diagrams of other, non-homogeneously impregnated particle filters of the invention.

FIG. 3 shows a particle filter 7 in cross-section. Its lateral modules 25 are impregnated with less catalyst than its most central modules 26.

Figure 4:
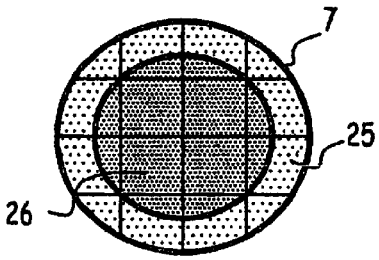

In this variant, the distribution of the catalyst in each module is substantially homogeneous. This need not always be the case, for example as shown in FIG. 4, where portions of the lateral modules 25 are also included in the region of higher impregnation, so as to impart a substantially circular cross-section to the region of higher impregnation.

The region of higher impregnation typically represents from 20% to 70% of the area of the cross-section of the particle filter 7. In this region, the quantity of catalyst is typically of the order of 1.5 to 5 times that in the less strongly impregnated regions.

A non-homogeneous distribution of the catalyst in the longitudinal direction of the particle filter 7 may also be envisaged, in addition to or instead of this particular radial distribution.

Figure 5:
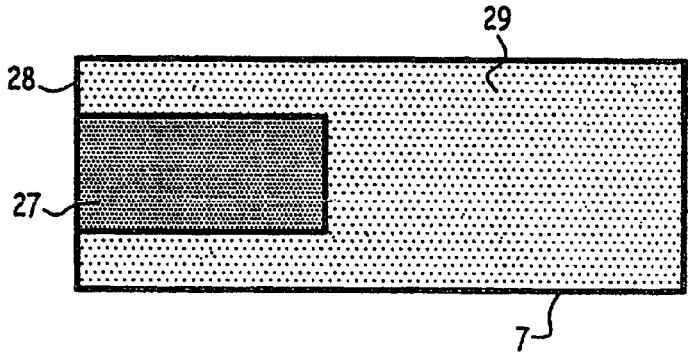

In FIG. 5, which is a diagram of the particle filter 7 in longitudinal section, the region 27 of higher impregnation, as well as not covering the whole of the cross-section of the particle filter 7, is present over only a portion of the length of the particle filter 7, typically from 10% to 50% or even 60% of that length starting from the inlet face 28 of the particle filter 7. In the remainder of the particle filter 7, homogeneous impregnation with a smaller quantity of catalyst constitutes a less strongly impregnated region 29.

Figure 6:
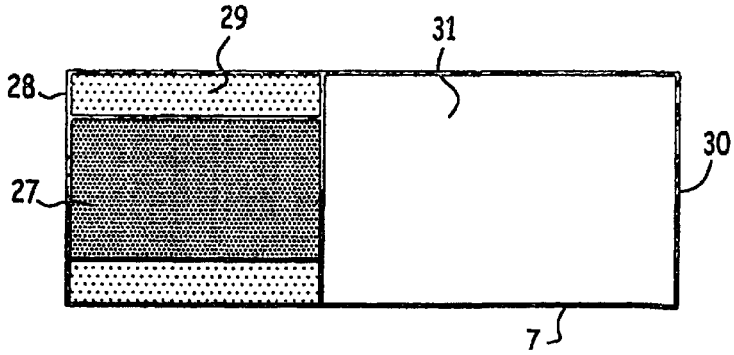

In FIG. 6, which is a diagram of the particle filter 7 in longitudinal section, the region 29 of weaker impregnation is interrupted short of the outlet face 30 of the particle filter 7, for example in line with the end of the region 27 of stronger impregnation, as shown here. There is therefore a non-catalytic region in the end portion 31 of the particle filter 7. In fact, in this end portion 31, in which ash from the additive from the tank 16 and diverse other impurities tend to accumulate, the catalyst is less efficient than in the region nearer the inlet of the particle filter 7. It is therefore less useful to impregnate this terminal portion 31, and eliminating it entirely provides a saving in material as well as limiting combustion gas head losses. Of course, this absence of catalyst in the terminal portion 31 of the particle filter 7 is equally applicable if the particle filter 7 is identically impregnated with the catalyst in all the impregnated regions.

Elements other than those described and shown may be added to the exhaust line 3 to confer additional functions on it or to improve existing functions, for example a $NO_x$ trap, as described above.

The invention may be exploited in two different ways.

A first way is for the combination of the oxidation catalyst and the particular filter to retain its usual volume. This increases the volume available for the deposition of soot, since deposition can now occur throughout the assembly and not only in its particle filter portion. This delays clogging of the particle filter and reduces the frequency of regeneration and thorough cleaning compared to the prior art (for example, thorough cleaning need take place only every 160,000 km or more, depending on the vehicles concerned, instead of every 80,000 km or 120,000 km).

A second way is to reduce the size of the combination of the oxidation catalyst and the particle filter to a size providing an available volume for the deposition of soot that is sufficient to impose a frequency of thorough cleaning of the particle filter comparable to that for prior art exhaust lines, in which the oxidation catalyst is separate from the particle filter. The advantage of the invention then lies in the reduced overall size of the assembly.

The invention finds a preferred application to diesel engine exhaust lines, but may be applied to the exhaust line of any type of internal combustion engine for which it is deemed necessary to use a particle filter.

The invention claimed is:

1. A system for assisting regeneration of a particle filter integrated in an exhaust line of a motor vehicle diesel engine, the engine being associated with various units, including:

means for admitting air into the engine;

means for recycling exhaust gases from the engine to the inlet thereof;

a turbocompressor;

a particle filter;

a common system for feeding fuel to the cylinders of the engine, including electrical fuel injectors associated with those cylinders;

means for adding to the fuel an additive adapted to be deposited on the particle filter to reduce the combustion temperature of particles trapped therein;

means for acquiring information relating to various operating parameters of the engine and the units associated therewith; and means for monitoring the operation of at least one of the air admission means, the recycling means, the turbocompressor and the fuel feeding system in order to monitor the operation of the engine, these monitoring means being further adapted to trigger a phase of regeneration of the particle filter by combustion of the particles trapped therein by triggering a phase of multiple injection of fuel into the cylinders of the engine during their expansion phase;

wherein the particle filter is impregnated with a catalyst for oxidizing hydrocarbons and CO present in the exhaust gases flowing through said particle filter, and wherein the particle filter has a region that is more strongly impregnated with the oxidation catalyst, wherein said more strongly impregnated region is situated at the centre of the cross-section of the particle filter.

2. A system according to claim 1, wherein the area of said more strongly impregnated region represents from 20% to 70% of the cross-section of said particle filter.

3. A system according to claim 1, wherein said catalyst is a metal or a mixture of metals.

4. A system according to claim 3, wherein the terminal portion of the particle filter is not impregnated with the oxidation catalyst.

5. A system according to claim 2, wherein said metal is a group VIII metal, such as platinum, palladium, or rhodium, or a mixture of such metals.

6. A system for assisting regeneration of a particle filter integrated in an exhaust line of a motor vehicle diesel engine, the engine being associated with various units, including:

means for admitting air into the engine;

means for recycling exhaust gases from the engine to the inlet thereof;

a turbocompressor;

a particle filter;

a common system for feeding fuel to the cylinders of the engine, including electrical fuel injectors associated with those cylinders;

means for adding to the fuel an additive adapted to be deposited on the particle filter to reduce the combustion temperature of particles trapped therein;

means for acquiring information relating to various operating parameters of the engine and the units associated therewith; and means for monitoring the operation of at least one of the air admission means, the recycling means, the turbocompressor and the fuel feeding system in order to monitor the operation of the engine, these monitoring means being further adapted to trigger a phase of regeneration of the particle filter by combustion of the particles trapped therein by triggering a phase of multiple injection of fuel into the cylinders of the engine during their expansion phase;

wherein the particle filter is impregnated with a catalyst for oxidizing hydrocarbons and CO present in the exhaust gases flowing through said particle filter, wherein the particle filter has a region that is more strongly impregnated with the oxidation catalyst, and wherein the more strongly impregnated region occupies from 10% to 50% of the length of the particle filter starting from its inlet face.

* * * * *